US008596835B2

(12) United States Patent
Dai

(10) Patent No.: US 8,596,835 B2
(45) Date of Patent: Dec. 3, 2013

(54) LED UNDERWATER LAMP

(75) Inventor: Zhongguo Dai, Guangzhou (CN)

(73) Assignee: Guangzhou Rising Dragon Electronics & Plastics Technology Co., Ltd, Guangzhou (CN)

( * ) Notice: Subject to any disclaimer, the term of this patent is extended or adjusted under 35 U.S.C. 154(b) by 0 days.

(21) Appl. No.: 13/381,665

(22) PCT Filed: Aug. 3, 2009

(86) PCT No.: PCT/CN2009/073057
§ 371 (c)(1),
(2), (4) Date: Dec. 30, 2011

(87) PCT Pub. No.: WO2011/000175
PCT Pub. Date: Jan. 6, 2011

(65) Prior Publication Data

US 2012/0113654 A1 May 10, 2012

(30) Foreign Application Priority Data

Jul. 1, 2009 (CN) ..... 2009 2 0059463 U

(51) Int. Cl.
*B60Q 1/00* (2006.01)

(52) U.S. Cl.
USPC ..... 362/368; 362/217.01; 362/217.1; 362/217.12; 362/311.02; 362/477; 362/101; 362/267

(58) Field of Classification Search
USPC ..... 362/217.01, 217.1, 217.12, 217.14, 362/217.16, 253, 267, 368, 375, 477, 581, 362/101, 311.02
See application file for complete search history.

(56) References Cited

FOREIGN PATENT DOCUMENTS

| | | | |
|---|---|---|---|
| CN | 2816597 | Y | 9/2006 |
| CN | 2828566 | Y | 10/2006 |
| CN | 201028333 | Y | 2/2008 |

OTHER PUBLICATIONS

International Search Report of PCT/CN2009/073057.

*Primary Examiner* — Stephen F Husar
*Assistant Examiner* — Meghan Dunwiddie

(57) ABSTRACT

An LED underwater lamp comprises a housing (1) and an LED lamp body (2), wherein the housing (1) is fixed in a mounting hole of a mounting plate (20), an opening is provided at one end of the housing (1), the LED lamp body (2) is inserted through the opening and fastened within the housing (1), an inner water-proof sealing ring (3) is disposed between the LED lamp body (2) and the opening of the housing (1), an LED bulb (4) is disposed within the LED lamp body (1) situated at the opening of the housing (1), and a power line (5) extending to outside through the housing (1) is detachably connected to the other end of the LED lamp body (2).

4 Claims, 8 Drawing Sheets

LED UNDERWATER LAMP

FIELD OF THE INVENTION

The present invention relates to an LED underwater lamp, and particularly to an LED underwater lamp used in a bathtub.

BACKGROUND OF THE INVENTION

At present, LED lamps are fixed to the wall of a bathtub. In this way, the colorful light that they emit is used for decoration so that they could bring visual aesthetic feeling for humans bathing in the bathtub. For this purpose, the LED underwater lamp used in the bathtub is popular with customers. However, the structure of such product in the prior art is relatively simple, which comprises an LED lamp body, an LED bulb disposed inside the LED lamp body and a power line integrated with one end of the LED lamp body. During mounting, the LED lamp body is directly mounted into a hole in the wall of the bathtub through a retaining nut. In this way, the retaining nut has to be screwed off from an inner side of the bathtub when it is needed to replace the LED lamp body, and it is requested that the whole outer housing of the bathtub is open. Therefore, the replacement is relatively troublesome and time-consuming. Moreover, water-proof treatment needs to be carried out after the replacement, which further results in very low efficiency.

SUMMARY OF THE INVENTION

The objective of the present invention is to provide an LED underwater lamp which is reasonable in structure design, and convenient and efficient for replacement of the LED lamp body, aiming at the above-mentioned disadvantages in the prior art.

In order to achieve the above-mentioned object, the following technical solution is provided in the present invention:

According to an aspect, an LED underwater lamp is provided, wherein the LED underwater lamp comprises a housing and an LED lamp body; wherein the housing is fixed in a mounting hole of a mounting plate, an opening is provided at one end of the housing, the LED lamp body is inserted through the opening and fastened within the housing, an inner water-proof sealing ring is disposed between the LED lamp body and the opening of the housing, an LED bulb is disposed within the LED lamp body situated at the opening of the housing, and a power line extending to outside through the housing is detachably connected to the other end of the LED lamp body.

The LED underwater lamp as mentioned above, wherein the LED lamp body is fixed rotatably within the housing through a rotational fastening structure.

The LED underwater lamp as mentioned above, wherein a groove is formed on the outside surface of the LED lamp body.

The LED underwater lamp as mentioned above, wherein the rotational fastening structure comprises an internal thread disposed on the inner wall of the housing and an external thread disposed on the outer wall of the LED lamp body, wherein the external thread engages with the internal thread.

The LED underwater lamp as mentioned above, wherein the rotational fastening structure comprises a plurality of snap-platforms which are disposed on the inner wall of the housing and surround in annular shape; a snap surface is disposed at the side of snap-platforms which is far away from the opening of the housing and the snap surface is an inclined cambered surface; a hook which can slide along the snap surface is disposed on the outer wall of the LED lamp body; the hook is provided with an inclined plane engaging with the snap surface.

The LED underwater lamp as mentioned above, wherein a step is disposed at the end of the housing with the opening and the step can clip onto one side of the mounting plate; an outer water-proof sealing ring is disposed between the step and the mounting plate; an external thread is disposed on the outer wall of the housing and the external thread is connected with a retaining nut; the retaining nut can clip onto the other side of the mounting plate.

The LED underwater lamp as mentioned above, wherein a female protruding block is detachably fixed within the housing, one end of the female protruding block is connected with the power line; a male protruding block that plugs in the female protruding block is detachably fixed on the LED lamp body.

When implementing the present invention, the following advantageous effect can be achieved: 1. since a housing always fixed on the bathtub is included in the invention, there is no need to remove the housing when it is required to replace the LED lamp body; instead, it is only needed to rotate the LED lamp body with its loading/unloading tool to finish its dismounting; after that, an efficient and convenient replacement of a new LED lamp body is achieved through the rotation by such loading/unloading tool; the operations are relatively simple and convenient. 2. The present invention is reasonable in structure design and easy to produce in a large scale. 3. Since both inner and outer sealing rings are employed, the water-proof effect of the present invention is excellent.

BRIEF DESCRIPTION OF THE DRAWINGS

The present invention will be described in detail with reference to the accompanying drawings and embodiments, in the accompanying drawings.

DETAILED DESCRIPTION OF THE PREFERRED EMBODIMENT

Figure 1:
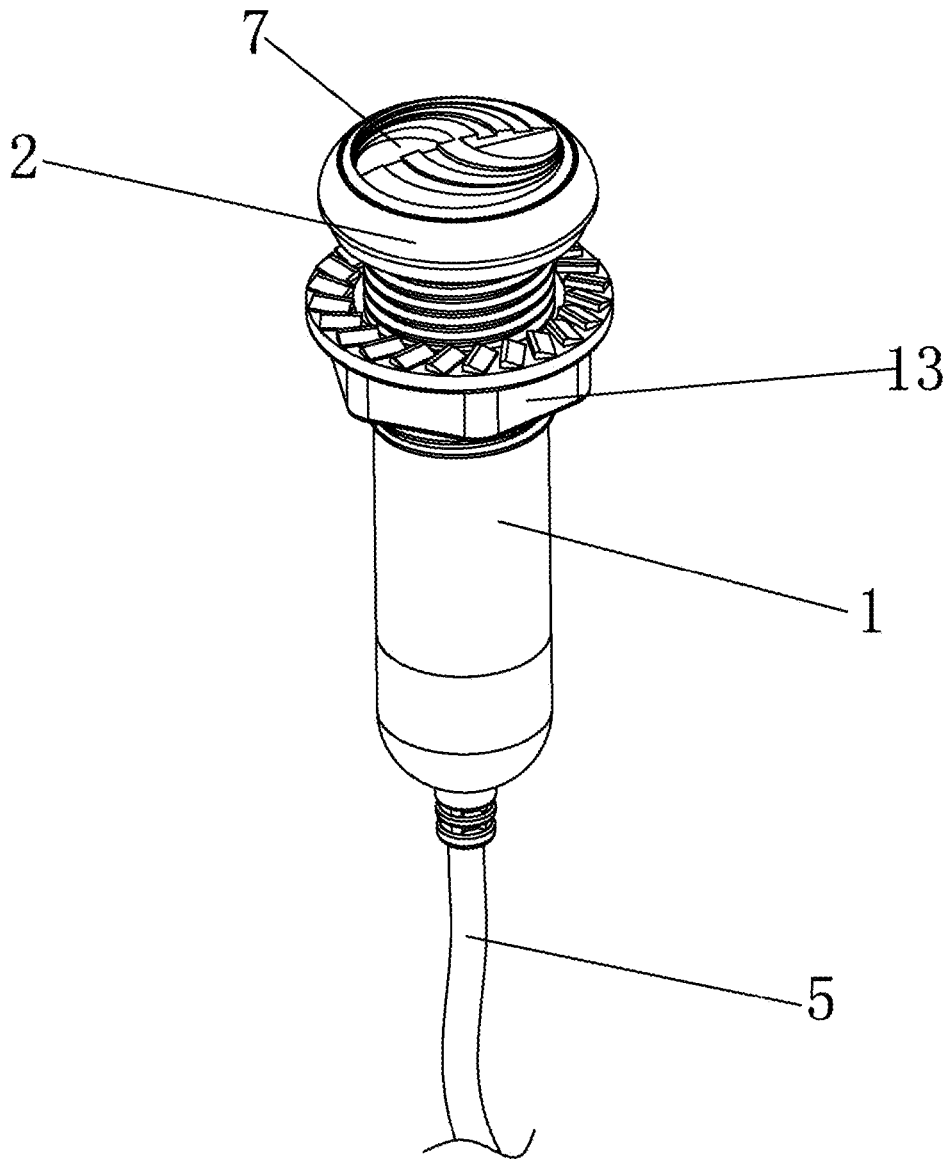
FIG. 1 is a perspective view of the embodiment 1.
Figure 2:
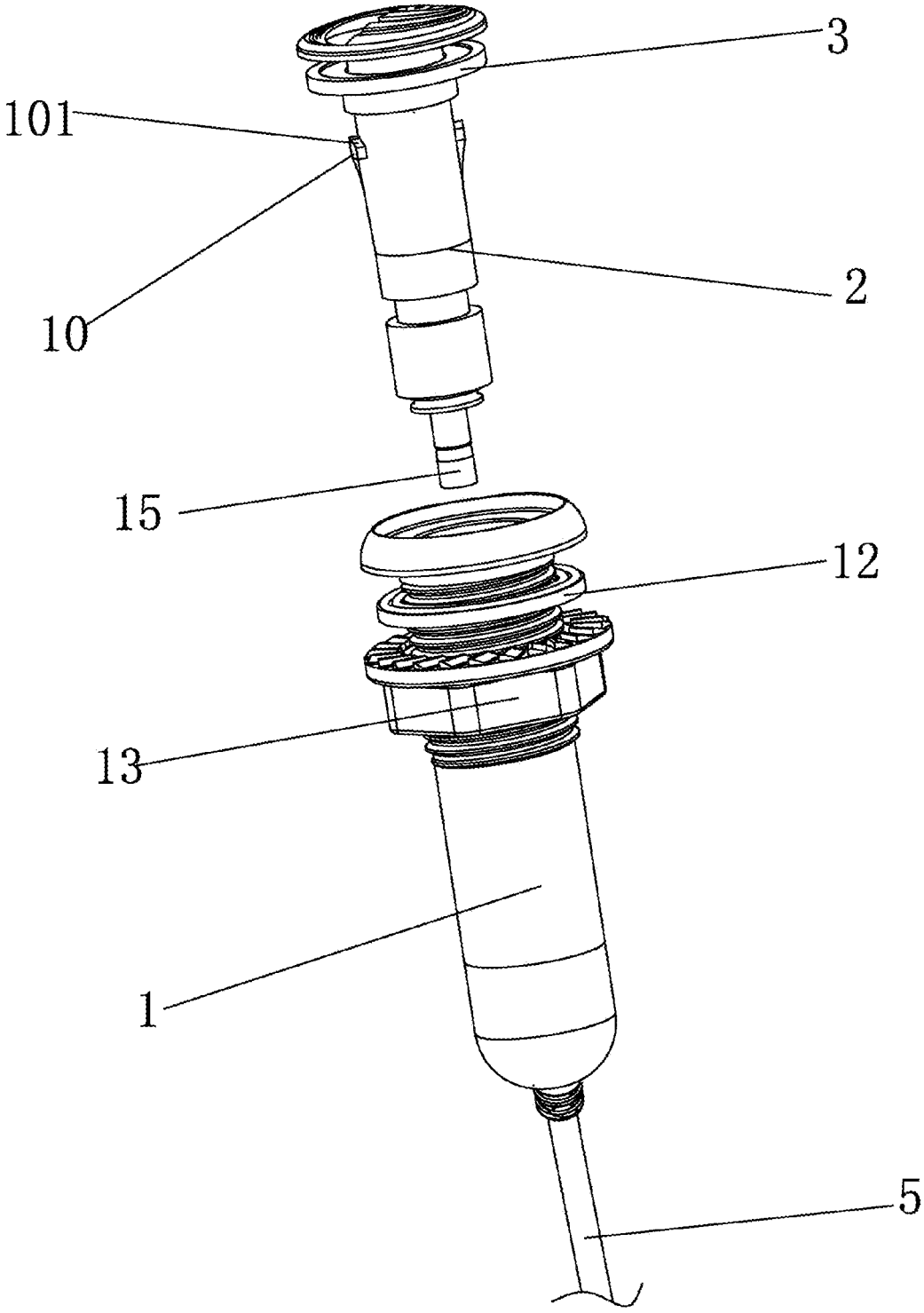
FIG. 2 is an exploded view of the embodiment 1.
Figure 3:
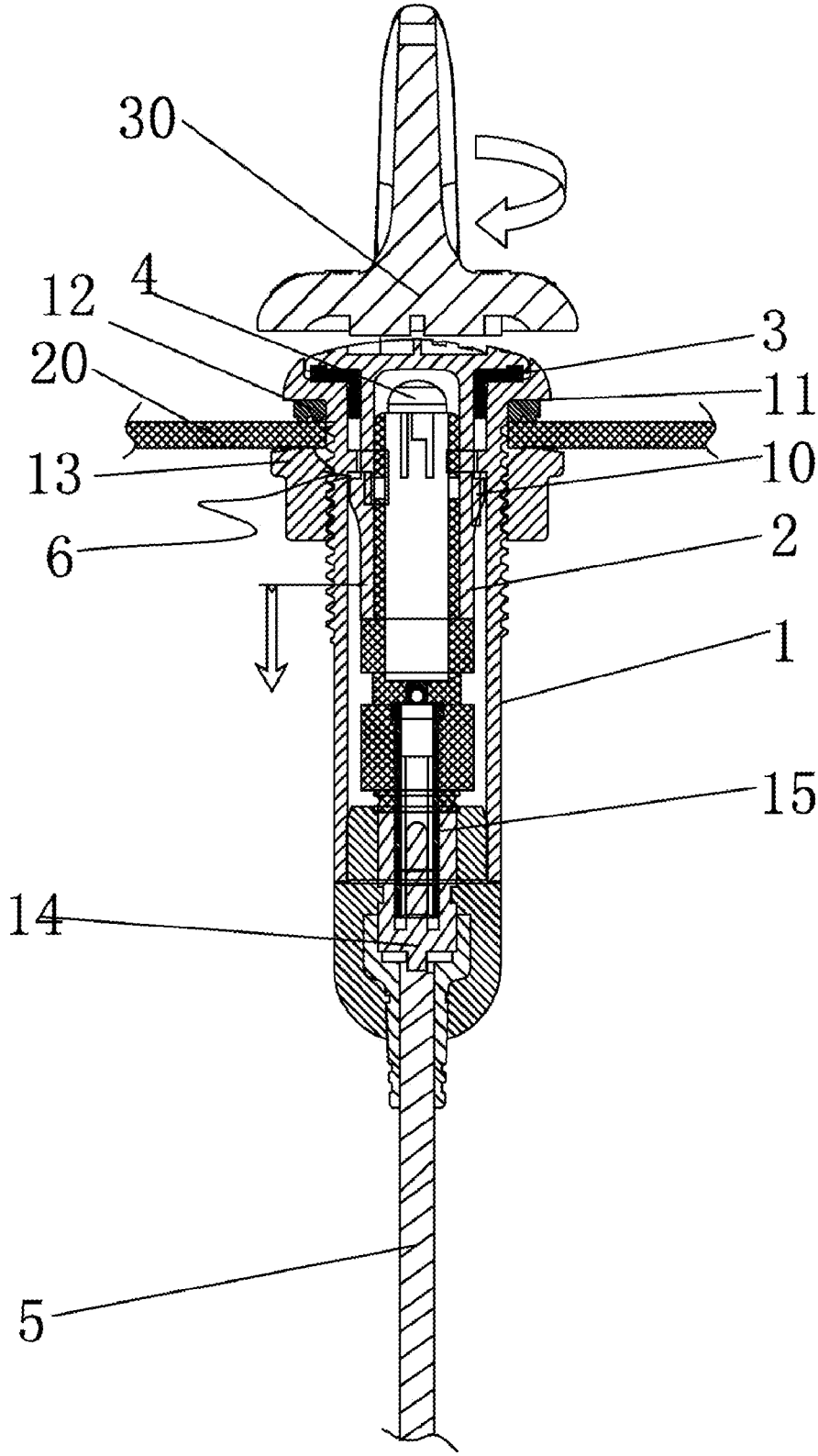
FIG. 3 is a cross-sectional view of the embodiment 1 in its use state.
Figure 4:
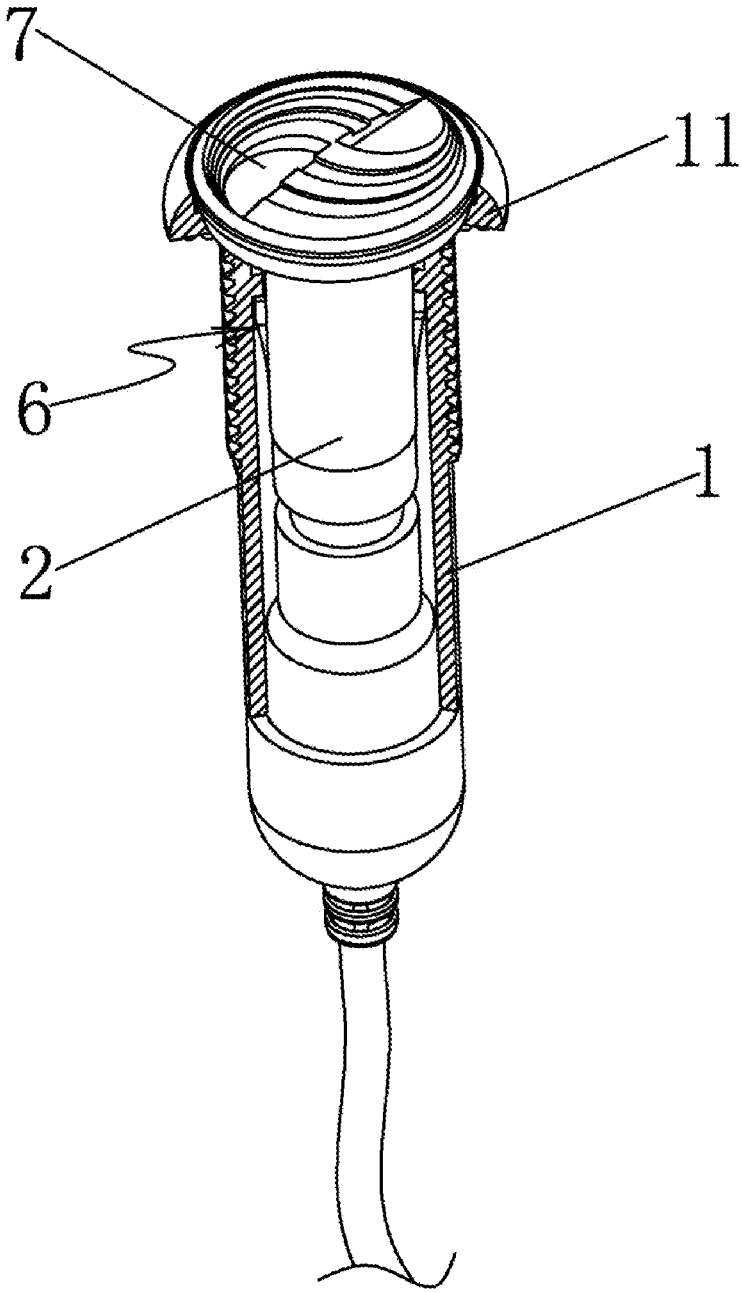
FIG. 4 is a schematic diagram showing the engagement between the LED lamp body and the housing through the hook and snap-platforms in the embodiment 1.
Figure 5:
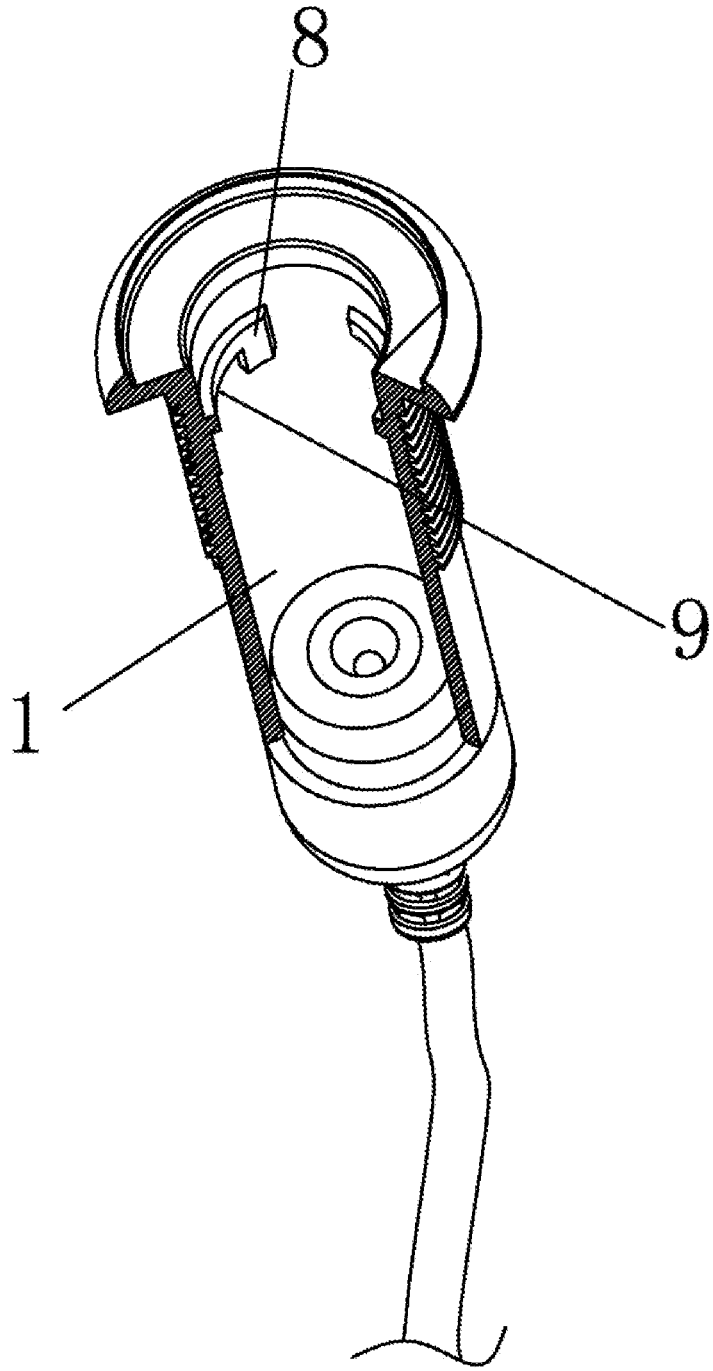
FIG. 5 is a schematic diagram of the embodiment 1, wherein a portion of the housing is cut out and the snap-platforms can be seen.

Detailed description will be made with reference to the accompanying drawings and embodiments of the present invention in the following: the present invention is an LED underwater lamp which comprises a housing 1 and an LED lamp body 2. Wherein the housing 1 is fixed in a mounting hole of a mounting plate 20 (if it is mounted within a bathtub, the mounting plate 20 refers to the wall of the bathtub), an opening is provided at one end of the housing, the LED lamp body 2 is inserted through the opening and fastened within the housing 1, an inner water-proof sealing ring 3 is disposed between the LED lamp body 2 and the opening of the housing 1, an LED bulb 4 is disposed within the LED lamp body 2 situated at the opening of the housing 1, and a power line 5 extending to outside through the housing 1 is detachably connected to the other end of the LED lamp body 2. The LED bulb 4 is sealed inside the LED lamp body 2, thus possessing a water-proof performance to prevent the water from invading inside. The LED lamp body 2 may be fixed rotatably within the housing 1 through a rotational fastening structure 6.

Figure 8:
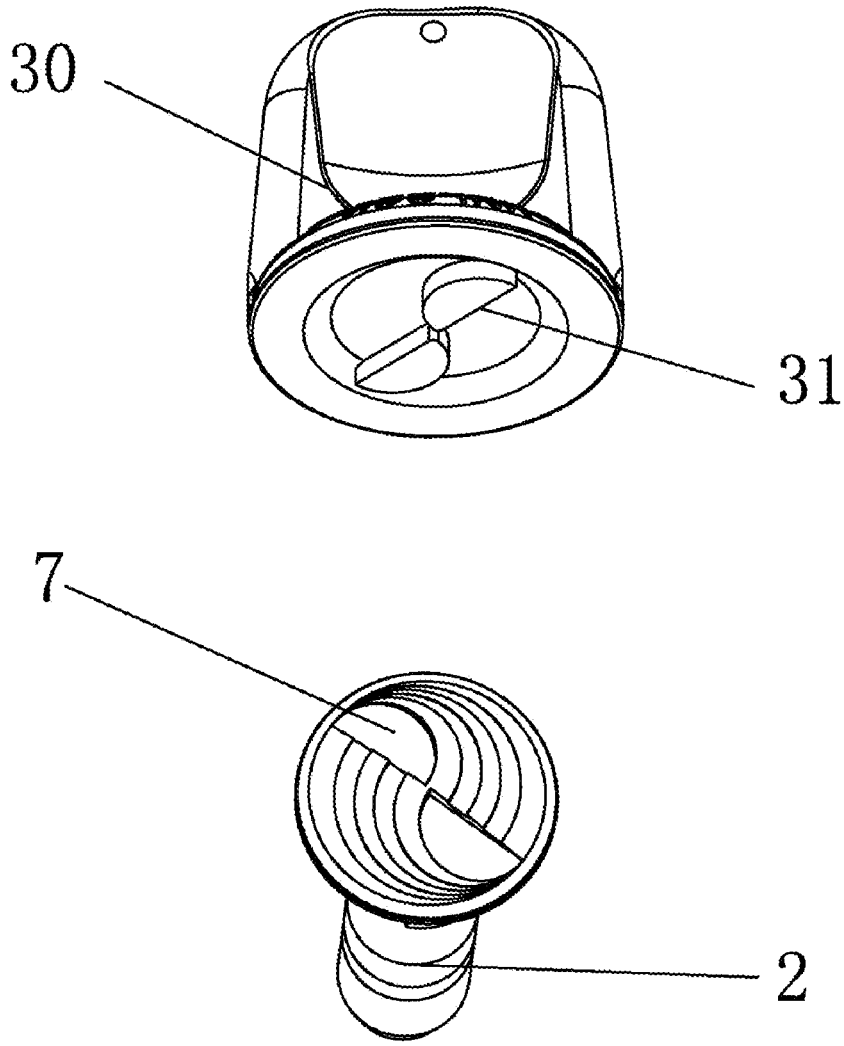
FIG. 8 is a perspective view o the LED lamp body and its loading/unloading tool.

Referring to FIG. 8, a groove 7 is formed on the outside surface of the LED lamp body 2, and a protruding block 31 engaging with the groove 7 is disposed on the loading/unloading tool 30 of the LED lamp body. When it is needed to dismount the LED lamp body, the protruding block 31 on the loading/unloading tool 30 of the LED lamp body is aligned with the groove 7, and then the loading/unloading tool 30 is rotated so as to be dismounted the LED lamp body 2 conveniently. When mounting the LED lamp body, it only requires rotation in an opposite direction.

Referring to FIG. 1-5, there is the embodiment 1 of the present invention. In the embodiment, the rotational fastening structure 6 comprises a plurality of snap-platforms 8 which are disposed on the inner wall of the housing 1 and surround in annular shape. A snap surface 9 is disposed at the side of the snap-platforms 8 which far away from the opening of the housing 1 and the snap surface 9 is an inclined cambered surface. A hook 10 which can slide along the snap surface 9 is disposed on the outer wall of the LED lamp body 2. The hook 10 is provided with an inclined plane 101 engaging with the snap surface 9.

Figure 6:
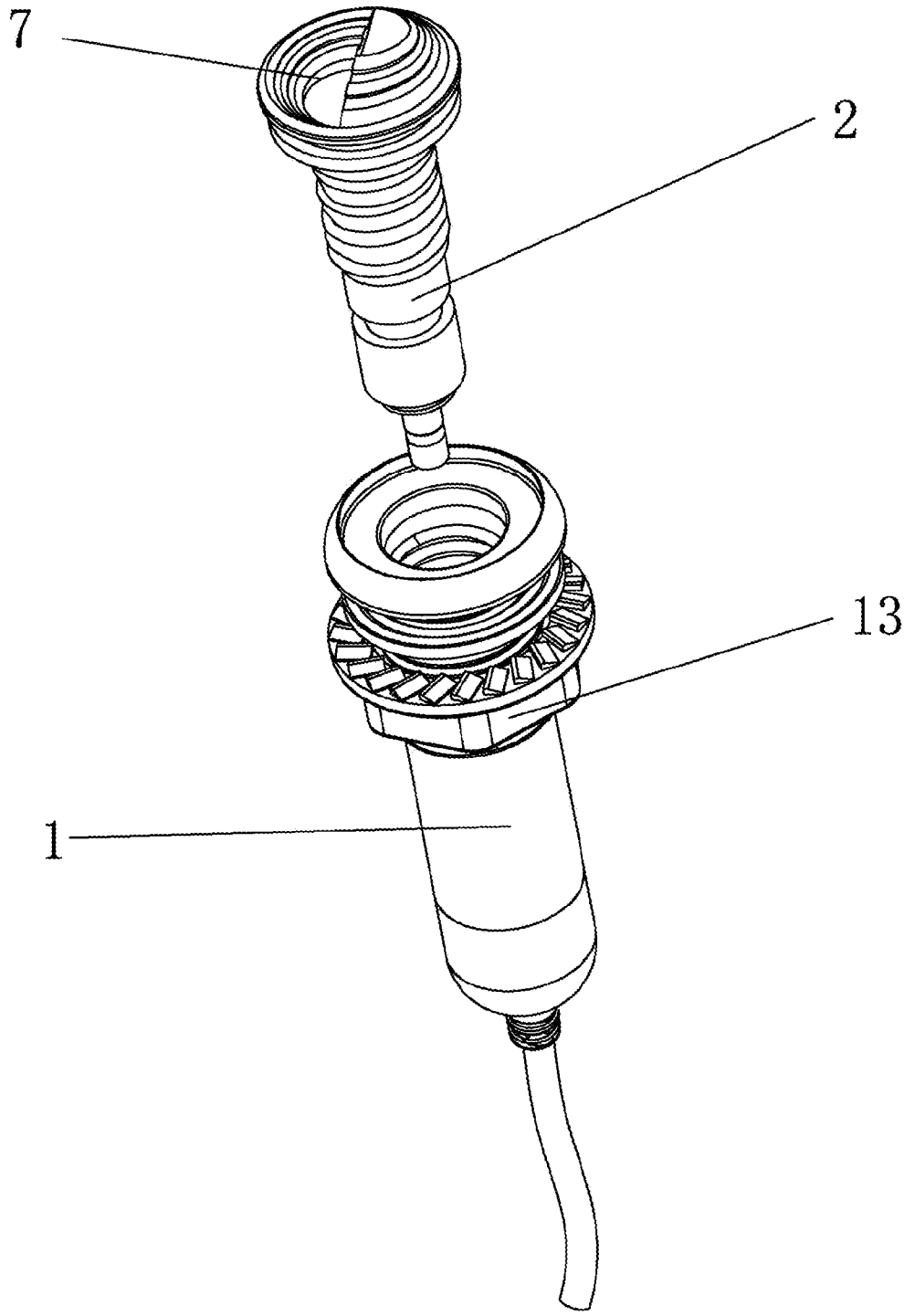
FIG. 6 is an exploded view of the embodiment 2.
Figure 7:
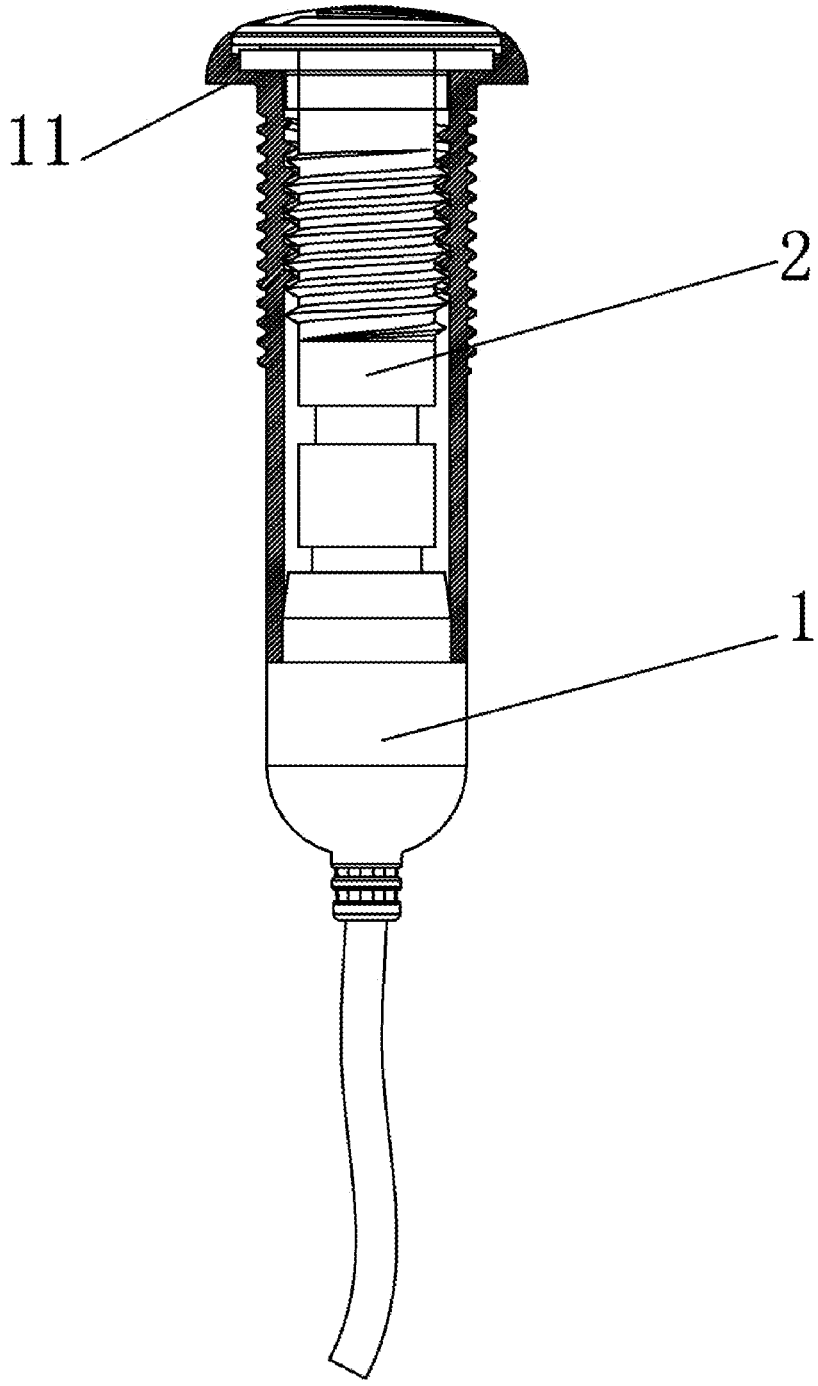
FIG. 7 is a partial cross-sectional view of the embodiment 2.

Referring to FIG. 6-7, there is the embodiment 2 of the present invention. In the embodiment, the rotational fastening structure 6 comprises an internal thread disposed on the inner wall of the housing 1 and an external thread disposed on the outer wall of the LED lamp body 2, wherein the external thread engages with the internal thread.

The above-mentioned two embodiments have the following same features. In order to fix the housing onto the mounting plate, a step 11 is disposed at the end of the housing 1 with the opening and the step 11 can clip onto one side of the mounting plate 20. An outer water-proof sealing ring 12 is further disposed between the step 11 and the mounting plate 20. An external thread is disposed on the outer wall of the housing 1 and the external thread is connected with a retaining nut 13, wherein the retaining nut 13 can clip onto the other side of the mounting plate 20. In order to separate the LED lamp body from the power line easily, a female protruding block 14 is detachably fixed within the housing 1, and one end of the female protruding block is connected with the power line 15. A male protruding block 15 that plugs in the female protruding block 14 is detachably fixed on the LED lamp body 2.

The invention claimed is:

1. An LED underwater lamp, comprising:

a housing (1), one end of which is provided with an opening and the other end of which is provided with a power line (5); the end with the opening is provided with a step (11) that can clip onto one side of a mounting plate (20); the housing can be fixed onto the mounting plate (20) through a retaining nut (13) engaging with an external thread on the outer wall of the housing (1); and an LED lamp body (2) which is provided with an LED bulb (4) inside and fixed rotatably within the housing (1) through a rotational fastening structure (6);

the rotational fastening structure comprises a plurality of snap-platforms (8) which are disposed on the inner wall of the housing (1) and surround in annular shape; a snap surface (9) is disposed at the side of the snap-platforms (8) which is far away from the opening of the housing (1) and the snap surface (9) is an inclined cambered surface; a hook (10) which can slide along the snap surface is disposed on the outer wall of the LED lamp body (2) and the hook is provided with an inclined plane (101) engaging with the snap surface (9); the rotational fastening structure (6) also comprises an internal thread disposed on the inner wall of the housing (1) and an external thread disposed on the outer wall of the LED lamp body (2), wherein the external thread engages with the internal thread.

2. The LED underwater lamp as set forth in claim 1, wherein an inner water-proof sealing ring (3) is disposed between the LED lamp body (2) and the opening of the housing (1), and an outer water-proof sealing ring (12) is disposed between the step (11) of the housing (1) and the mounting plate (20).

3. The LED underwater lamp as set forth in claim 2, wherein the LED underwater lamp further comprises a female plug (14) which is connected with the power line (5) and a male plug (15) which is connected with the LED bulb (4); wherein the female plug (14) is connected with the male plug (15) by plugging.

4. The LED underwater lamp as set forth in claim 3, wherein a groove (7) engaging with a tool (30) is disposed on the outside surface on the top of the LED lamp body (2) so as to facilitate the dismounting of the LED lamp body (2) from the housing (1).

* * * * *